United States Patent [19]

Lowe

[11] Patent Number: 4,696,522

[45] Date of Patent: Sep. 29, 1987

[54] CABINET FOR MICROCOMPUTER COMPONENTS

[75] Inventor: Gary M. Lowe, San Jose, Calif.

[73] Assignee: Devoke Co., Santa Clara, Calif.

[21] Appl. No.: 861,430

[22] Filed: May 9, 1986

[51] Int. Cl.[4] ..... E06B 9/14

[52] U.S. Cl. ..... 312/297; 312/208

[58] Field of Search ..... 312/196, 194, 297, 208

[56] References Cited

U.S. PATENT DOCUMENTS

| | | | |
|---|---|---|---|
| 1,712,842 | 5/1929 | Richardson | 312/196 |
| 2,172,414 | 7/1939 | Sherman . | |
| 2,300,984 | 4/1942 | Smith . | |
| 2,865,700 | 2/1958 | Myers . | |
| 4,107,700 | 12/1978 | Jornod . | |
| 4,226,410 | 9/1980 | McIntosh et al. . | |
| 4,431,238 | 2/1984 | Evans | 312/196 X |
| 4,515,490 | 3/1985 | Marker, III . | |
| 4,544,065 | 10/1985 | Mueller | 312/196 X |
| 4,563,102 | 1/1986 | Sanders, Jr. et al. | 400/691 |

OTHER PUBLICATIONS

Grolen Incorporated, "SpaceMizer," two-page, undated brochure.

*Primary Examiner*—Joseph Falk

[57] ABSTRACT

A cabinet for housing microcomputer components is provided. The cabinet includes a plurality of shelves for supporting a printer and a supply of paper and space for storing a stack of printed paper. A sliding tambour door moves between an open and closed position. In its closed position, the tambour door provides an enclosed, locking front wall securing the contents of the cabinet. In its open position, the tambour door forms a baffle which serves to fold and stack the printed paper in a fanfold stack below the printer.

2 Claims, 4 Drawing Figures

CABINET FOR MICROCOMPUTER COMPONENTS

BRIEF SUMMARY OF THE INVENTION

This invention pertains to a cabinet which organizes, stores and secures computer components. In particular, this invention relates to a storage cabinet for microcomputer components in which a tambour door moves between an open and closed position. In its closed position, the tambour door forms a front wall of the cabinet which seals and encloses the components stored within the cabinet, and the tambour door may be locked in its closed position. The tambour door slides to an open position in which the tambour door lies generally against the rear wall of the cabinet, with the lowermost portion of the tambour door forming a baffle in the paper path of the printer, the baffle serving to fold and stack the printed paper in a fanfold stack on a shelf below the printer.

A primary object of the invention is to provide a compact, versatile storage cabinet for computer components in which a tambour door is utilized as a security door in one position and which is utilized as a baffle in the printer paper path in its open position.

A further object of the invention is to provide a compact cabinet for microcomputer components in which the components are easily accessible and usable when the cabinet is in its unlocked, open position and in which most of the components are secured under lock and key in its closed position.

A further object of the invention is to provide a compact and mobile work station which positions the monitor and keyboard at comfortable viewing and keying heights and which provides a paper path for delivering printout upfront for easy access with minimum space requirements.

Further objects and advantages will become apparent from the following description of the preferred embodiment and from the drawings in which:

DETAILED DESCRIPTION OF THE DRAWINGS

Figure 1:
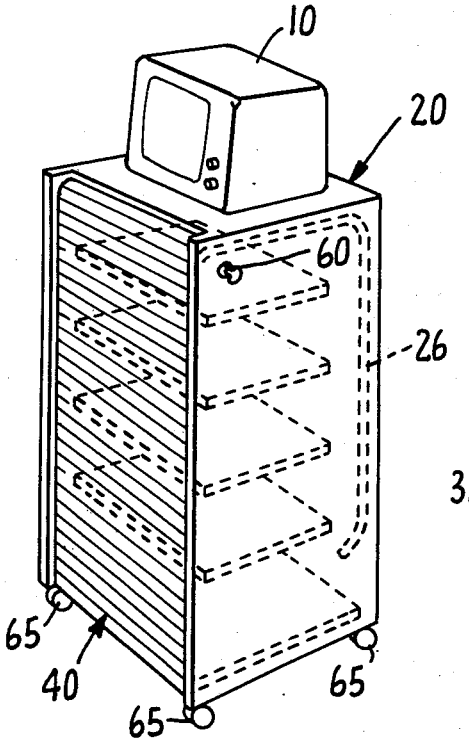
FIG. 1 is a perspective view of the cabinet according to the present invention shown in its closed or locked position.

Referring to the drawings, FIG. 1 shows the cabinet 20 for housing microcomputer components in its closed position. A monitor 10, a central processing unit 11 and keyboard 12 are shown which do not form a part of this invention. The drawings also show a printer 13, a paper supply 14 for printer 13 and a stack of printed paper 15. According to this invention, the paper path and the folding and stacking of the printed paper are related to the instant invention as described below.

Cabinet 20 comprises a pair of side walls 21 and 22, a rear wall 23 and top 24.

Side walls 21 and 22 support shelf means which includes shelves 31, 32, 33, 34 and 35. It is understood that the lowermost shelf 35 may also form the base of the cabinet 20. Shelf 32 supports keyboard 12 and is a sliding shelf moving in track 32*a*. Shelf 33 supporting printer 13 is also a sliding shelf moving in track 33*a*.

Tambour door means 40 comprises a plurality of elongated, parallel strips 41 joined by either particulating joints formed in each strip or by any suitable flexible material which allows strips 41 to rotate about their longitudinal axes with respect to adjacent strips. Tambour door means 40 is shown in its closed position in FIG. 1. In this closed position, locking means 60 is used to lock the tambour door means 40 as by rotating a steel finger into position adjacent the upper end of tambour door means 40.

Figure 2:
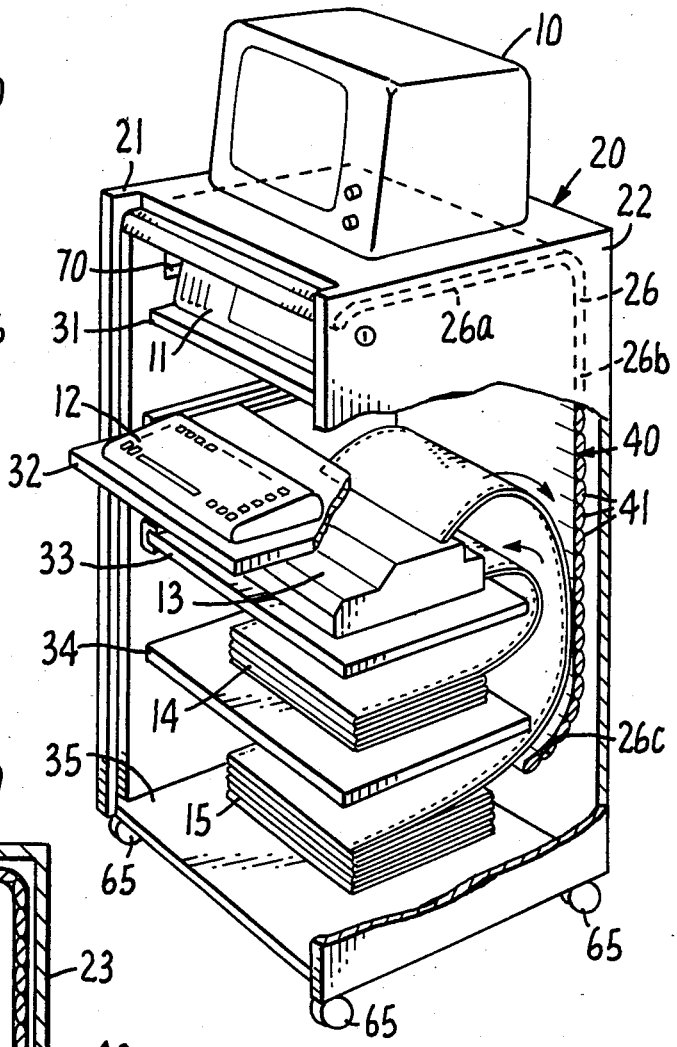
FIG. 2 is a perspective view, shown partially in section, of the cabinet according to the present invention shown in its open position.
Figure 3:
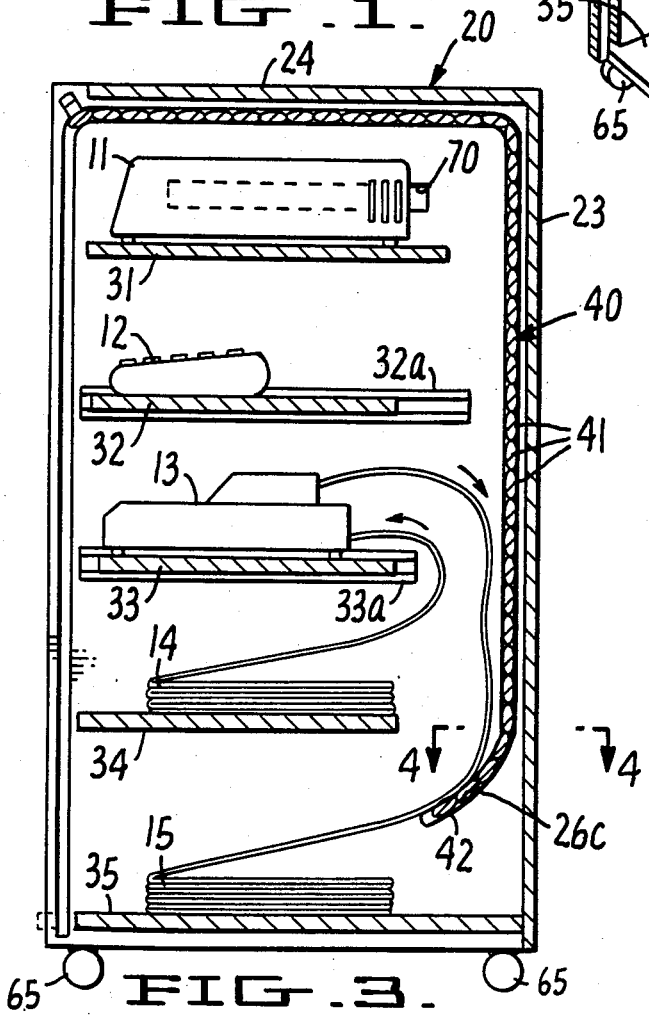
FIG. 3 is a sectional view of the cabinet according to the present invention shown in its unlocked position with microcomputer components shown on the shelves.
Figure 4:
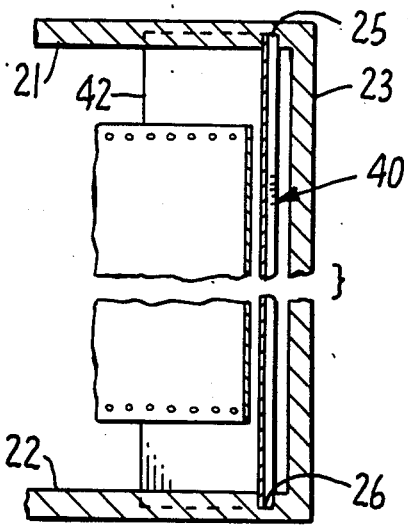
FIG. 4 is a section along the line 4—4 of FIG. 3.

Tambour door means 40 is shown in its oper or unlocked position in FIGS. 2 and 3. Side walls 21 and 22 contain tambour door guides, 25 and 26 respectively, which are grooves formed in side walls 21 and 22 and which extend generally horizontally along the top portion of side walls 21 and 22 as shown as 26*a* in FIG. 2. Groove 26 extends downwardly parallel to rear wall 23 and adjacent rear wall 23 as shown as 26*b*. At its lowermost position, slot 26 forms an arcuate path extending downwardly and forwardly shown as 26*c*. When tambour door means 40 is in its open position, as shown in FIG. 3, the lower portion 42 of tambour door means 40 extends downwardly and forwardly so as to form a baffle in the paper path.

As shown in FIG. 3, paper supply 14 of unused paper is carried on shelf 34 immediately beneath shelf 33 on which printer 13 is positioned. The paper path follows the direction of the arrows shown in FIG. 3 and, upon exiting the printer, the paper is guided by tambour door means 40 downwardly to the baffle formed by the lower portion 42 of the tambour door means 40. The baffle 42 serves to fold and stack the printed paper in a fanfold stack on shelf 35 located beneath printer 13 and beneath paper supply 14. Lower portion 42 of tambour door means 40 extends sufficiently forwardly to stack the paper 15 close to the front of cabinet 20 for easy access.

Casters 65 are provided so that the unit is easily mobile.

A vent 70 is provided adjacent the central processing unit 11 in side wall 21 to minimize overheating of CPU 11.

In use, the operator simply unlocks tambour door means 40, moves it to its open position as shown in FIG. 2, pulls the printer 13 outwardly by moving sliding shelf 33 outwardly and feeds paper into the printer, if necessary, and then moves the printer back to its position shown in FIG. 3. The user then simply pulls keyboard 12 outwardly on sliding shelf 32. Keyboard 12 is located at appropriate keyboard height above ground level for easy use, and monitor 10 is located at eye level use for a seated user. After completing use of the microcomputer, the operator removes any printed paper 15 which has been stacked on lower shelf 35 in a fanfold stack, returns keyboard 12 to the position shown in FIG. 3 and closes and locks tambour door means 40. In its locked position, cabinet 20 secures the keyboard 12, CPU 11, printer 13, paper 14 and printed paper 15, if desired. Cabinet 20 may be easily moved on casters 65 and is very compact, utilizing a minimum amount of floor space for the various components stored by the cabinet 20.

I claim:

1. A cabinet for housing microcomputer components comprising:

side walls a rear wall a top shelf means for supporting a printer, a supply of paper for said printer and a stack of printed paper, said paper passing through said printer and moving downwardly toward said stack of printed paper, each of said side walls having a tambour door guide, comprising a groove formed therein in which a tambour door means slides, said groove having a portion extending downwardly adjacent said rear wall, and said groove having a further portion extending forwardly below said printer towards the front of the cabinet tambour door means guided by said guide and movable between open and closed positions, said tambour door forming a front wall enclosing said cabinet in the closed position said tambour door means, in said open position, having an inturned end which is caused by the door being guided by the forwardly extending portion of the guide means so that in said open position said inturned end is positioned above said stack of printed paper and below said printer, said inturned end forming a baffle, said baffle serving to deflect, fold and stack said printer paper in a fanfold stack on a shelf below said printer.

2. The cabinet of claim 1 wherein said tambour door means extends sufficiently forward below said printer to stack said paper near the front of the cabinet for easy access.

* * * * *